US011040254B1

(12) United States Patent
Hill

(10) Patent No.: US 11,040,254 B1
(45) Date of Patent: Jun. 22, 2021

(54) GPS-LOCATING SPORTS BALL

(71) Applicant: Eric Hill, Columbia, SC (US)

(72) Inventor: Eric Hill, Columbia, SC (US)

( * ) Notice: Subject to any disclaimer, the term of this patent is extended or adjusted under 35 U.S.C. 154(b) by 37 days.

(21) Appl. No.: 16/687,764

(22) Filed: Nov. 19, 2019

(51) Int. Cl.
*A63B 43/00* (2006.01)

(52) U.S. Cl.
CPC ..... *A63B 43/00* (2013.01); *A63B 2220/12* (2013.01); *A63B 2220/20* (2013.01); *A63B 2220/30* (2013.01); *A63B 2220/40* (2013.01); *A63B 2225/50* (2013.01)

(58) Field of Classification Search
CPC ..... A63B 43/00; A63B 2220/12; A63B 2220/20; A63B 2220/30; A63B 2220/40; A63B 2220/50
See application file for complete search history.

(56) References Cited

U.S. PATENT DOCUMENTS

D414,229 S 9/1999 Sohn
8,540,583 B2 9/2013 Leech
8,882,606 B2 11/2014 Leech
2002/0177490 A1 11/2002 Yong
2005/0233815 A1 10/2005 McCreary
2007/0021226 A1* 1/2007 Tyroler ..... A63B 71/06 473/131
2008/0220892 A1 9/2008 Williamson
2009/0017944 A1* 1/2009 Savarese ..... A63B 69/3658 473/407
2018/0200583 A1* 7/2018 Thurman ..... A63B 69/002
2020/0047026 A1* 2/2020 Onuki ..... A61B 5/1114

FOREIGN PATENT DOCUMENTS

WO 2009009147 1/2009

* cited by examiner

*Primary Examiner* — Tramar Harper
*Assistant Examiner* — Jeffrey K Wong

(57) ABSTRACT

The GPS-locating sports ball comprises a ball, a locating circuit, and software. The locating circuit may determine one or more physical parameters of the ball. As a non-limiting example, the ball may be a golf ball, a tennis ball, a baseball, a softball, or a bowling ball. The locating circuit may communicate the one or more physical parameters to the software running on a smart device. The software may be operable to assist in locating a lost ball and in monitoring improvements in athletic performance based upon an analysis of the one or more physical parameters.

17 Claims, 3 Drawing Sheets

GPS-LOCATING SPORTS BALL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports equipment, more specifically, a GPS-locating sports ball.

SUMMARY OF INVENTION

The GPS-locating sports ball comprises a ball, a locating circuit, and software. The locating circuit may determine one or more physical parameters of the ball. As a non-limiting example, the ball may be a golf ball, a tennis ball, a baseball, a softball, or a bowling ball. The locating circuit may communicate the one or more physical parameters to the software running on a smart device. The software may be operable to assist in locating a lost ball and in monitoring improvements in athletic performance based upon an analysis of the one or more physical parameters.

An object of the invention is to determine one or more physical parameters of a sports ball.

Another object of the invention is to communicate the one or more physical parameters of the sports ball to software executing on a smart device.

A further object of the invention is to report the location of a lost sports ball.

Yet another object of the invention is to provide a mount for coupling a locating circuit to a sports ball.

These together with additional objects, features and advantages of the GPS-locating sports ball will be readily apparent to those of ordinary skill in the art upon reading the following detailed description of the presently preferred, but nonetheless illustrative, embodiments when taken in conjunction with the accompanying drawings.

In this respect, before explaining the current embodiments of the GPS-locating sports ball in detail, it is to be understood that the GPS-locating sports ball is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the GPS-locating sports ball.

It is therefore important that the claims be regarded as including such equivalent construction insofar as they do not depart from the spirit and scope of the GPS-locating sports ball. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
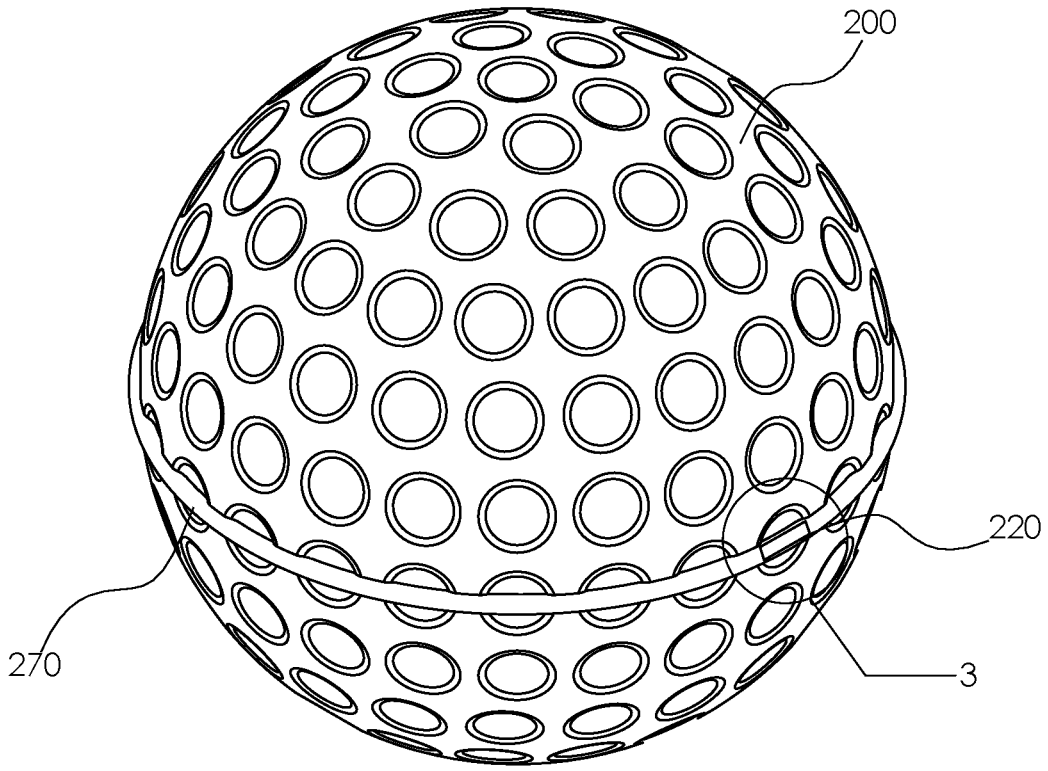
FIG. 1 is an isometric view of an embodiment of the disclosure.
Figure 2:
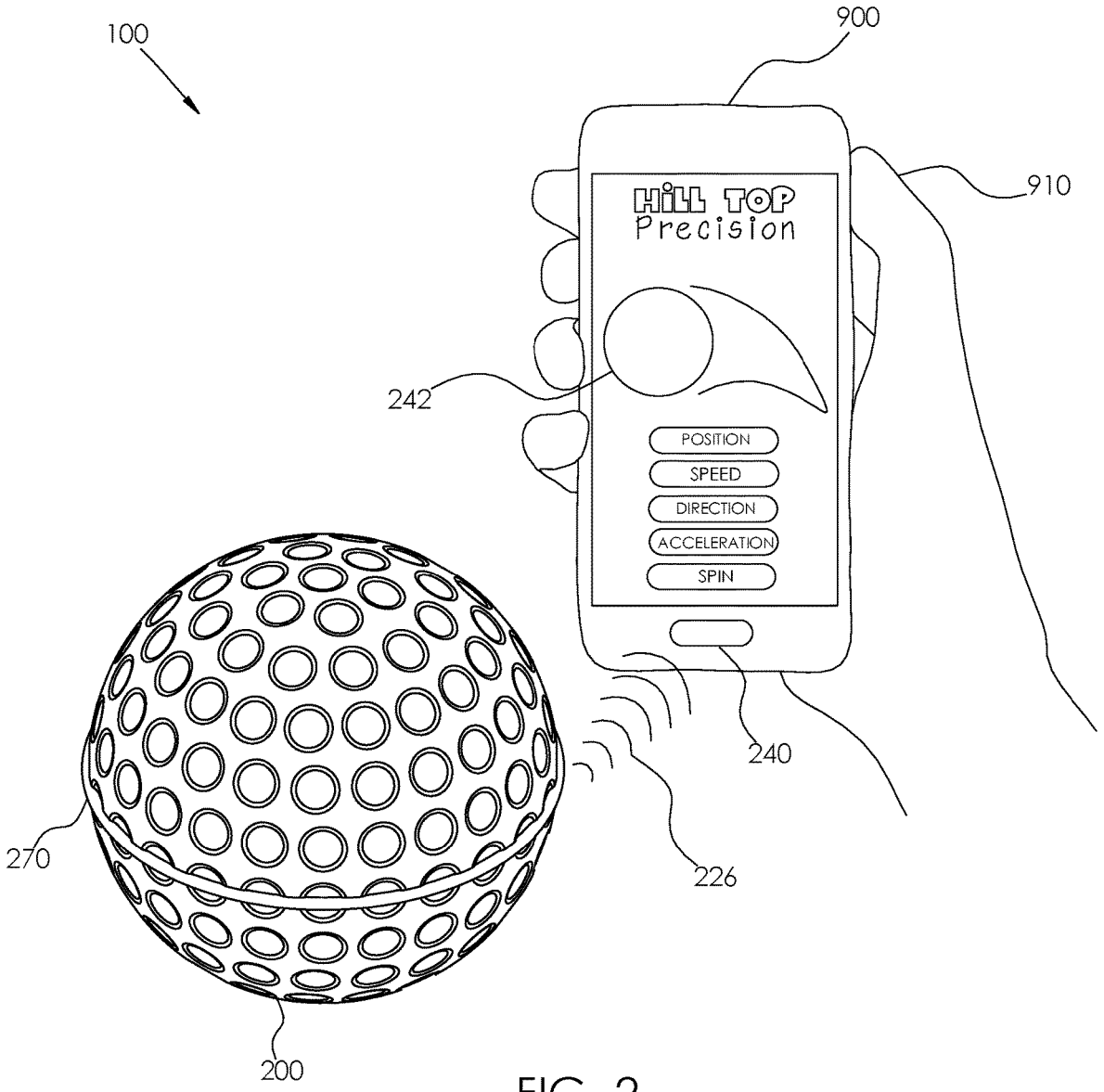
FIG. 2 is an in-use view of an embodiment of the disclosure.
Figure 3:
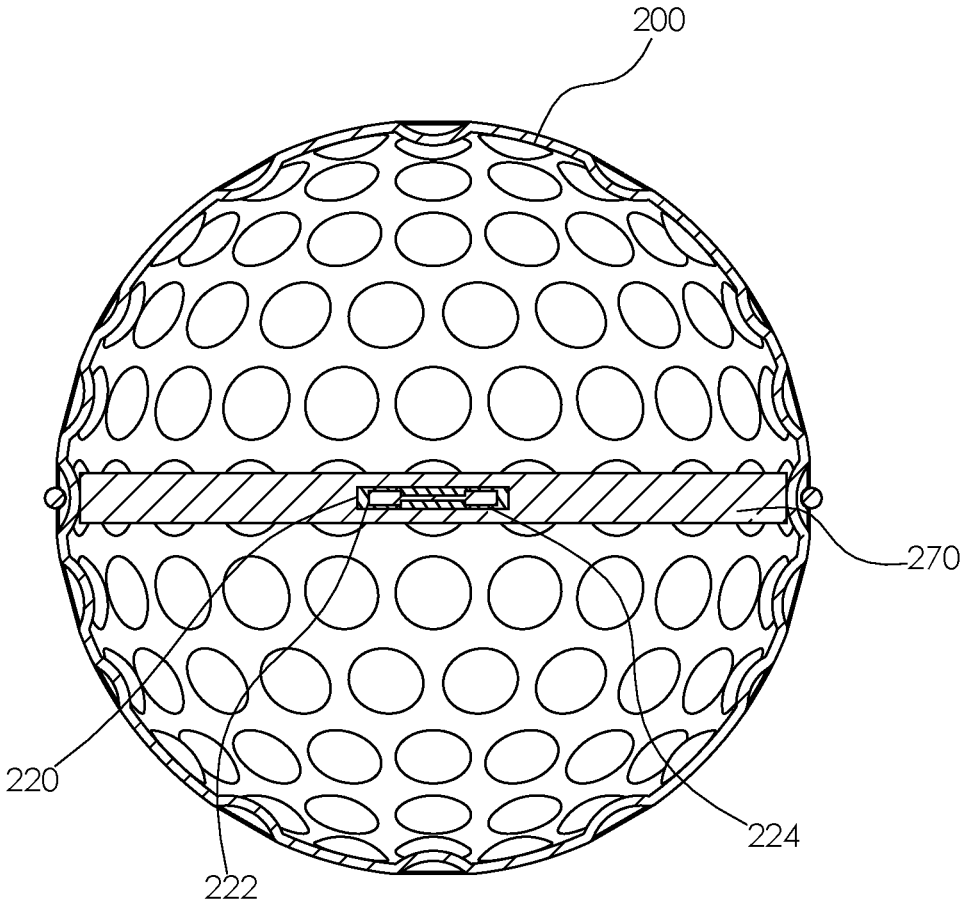
FIG. 3 is a detail view of an embodiment of the disclosure illustrating the area designated as 3 in FIG. 1.

Detailed reference will now be made to a first potential embodiment of the disclosure, which is illustrated in FIGS. 1 through 3.

The GPS-locating sports ball 100 (hereinafter invention) comprises a ball 200, a locating circuit 220, and software 240. The locating circuit 220 may determine one or more physical parameters of the ball 200. As a non-limiting example, the ball 200 may be a golf ball, a tennis ball, a baseball, a softball, or a bowling ball. The locating circuit 220 may communicate the one or more physical parameters to the software 240 running on a smart device 900. The software 240 may be operable to assist in locating a lost ball and in monitoring improvements in athletic performance based upon an analysis of the one or more physical parameters.

The locating circuit 220 may comprise a global positioning system 222 and a wireless transceiver 224. The locating circuit 220 may be coupled to the ball 200 such that movements of the locating circuit 220 correlate with movements of the ball 200. In some embodiments, the locating circuit 220 may be imbedded within the ball 200.

The global positioning system 222 may be a Global Positioning System receiver. The global positioning system 222 may receive plurality of radio signals from satellites in the constellation of GPS satellites. The global positioning system 222 may perform calculations to determine geolocation and time information. The global positioning system 222 may deliver the geolocation information, the time information, or both to the wireless transceiver 224.

The wireless transceiver 224 may exchange ball information and ball commands with the smart device 900 over a wireless communication link 226. As a non-limiting example, the ball information may comprise a positional history of the ball 200 within a 3D dimensional space. As a further non-limiting example, the ball commands may direct the ball 200 to clear the positional history log of the ball 200.

The software 240 may be operable to execute on one or more processors of the smart device 900. The software 240 may determine the value of the one or more physical parameters by analyzing the ball information sent from the ball 200 to the smart device 900. As a non-limiting example, the one or more physical parameters may comprise one or more position values. As a non-limiting example, the one or more physical parameters may comprise one or more speed values. As a non-limiting example, the one or more physical parameters may comprise one or more direction values. As a non-limiting example, the one or more physical parameters may comprise one or more acceleration values. As a non-limiting example, the one or more physical parameters may comprise one or more spin values. In some embodiments, the software 240 may determine an average value for at least one of the one or more physical parameters. In some embodiments, the software 240 may determine a minimum value for at least one of the one or more physical parameters. In some embodiments, the software 240 may determine a maximum value for at least one of the one or more physical parameters.

The software 240 may be adapted to interact with a user 910 via a user interface 242. The user interface 242 may report the one or more physical parameters and may be adapted to allow the user 910 to interact with the one or more physical parameters. As a non-limiting example, the software 240 may analyze the ball information to determine the one or more position values of the ball 200 over time while practicing a sporting skill. The software 240 may determine from the one or more position values of the ball 200 over time the degree of curvature in the path of the ball 200. The user 910 may practice the sporting skill repeatedly using various techniques to determine which techniques result in the most desirable degree of curvature. As non-limiting example, the sporting skill may comprise serving the tennis ball, pitching the baseball, shooting a basketball, and putting the golf ball.

In some embodiments, the locating circuit 220 may be removably coupled to the ball 200 using a mount 270. The mount 270 may be an elastic band having an unstretched diameter that is smaller than the diameter of the ball 200. The locating circuit 220 may be coupled to the mount 270. The mount 270 may be installed by stretching to have a diameter that is larger than the diameter of the ball 200, placing the mount 270 around an orthodrome of the ball 200, and releasing the mount 270 such that the mount 270 encircles the ball 200.

In use, the user 910 practices or plays a game using the ball 200. During use, the ball 200 may send the ball information to the smart device 900. The software 240 executing on the smart device 900 may present the one or more physical parameters derived from the ball information on the user interface 242. As non-limiting examples, the one or more physical parameters may assist in finding a lost ball, may present performance metrics associated with completing sporting skills, may compare and contrast multiple practice attempts at sporting skills, or combinations thereof.

Definitions

As used in this disclosure, a "ball" refers to an object with a spherical or nearly spherical shape.

As used in this disclosure, a "band" is a flat loop of material.

As used herein, the words "couple", "couples", "coupled" or "coupling", refer to connecting, either directly or indirectly, and does not necessarily imply a mechanical connection.

As used herein, the words "data" and "information" are used interchangeably to refer to raw, unprocessed facts and to facts that have been processed, structured, organized, or presented in a context that makes the facts useful.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, "elastic" refers to a material or object that deforms when a force is applied to stretch or compress the material and that returns to its relaxed shape after the force is removed. A material that exhibits these qualities is also referred to as an elastomeric material.

As used herein, "great circle" or "orthodrome" refers to a circle formed by the intersection of a sphere and a plane passing through the center of the sphere. The diameter of a great circle is the same as the diameter of the sphere.

As used herein, "GPS" refers to a device that uses signals received from a system of navigational satellites to determine the position of the device. GPS is an acronym for Global Positioning System.

As used herein, "smart device" refers to a portable electrical device comprising at least a processor, display, input device, and network connection. The input device is generally a touch screen, keyboard, or voice recognition. The network connection is generally wireless. Non-limiting examples of smart devices may include smartphones, tablets, personal digital assistants, laptop computers, and smartwatches.

As used in this disclosure, a "transceiver" is a device that is used to transmit and/or receive signals. The signals may be audible, optical, or RF in nature.

With respect to the above description, it is to be realized that the optimum dimensional relationship for the various components of the invention described above and in FIGS. 1 through 3, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A GPS-locating sports ball comprising:

a ball, a locating circuit, and software;

wherein the locating circuit determines one or more physical parameters of the ball;

wherein the locating circuit communicates the one or more physical parameters to the software running on a smart device;

wherein the software is operable to assist in locating a lost ball and in monitoring improvements in athletic performance based upon an analysis of the one or more physical parameters;

wherein the locating circuit is removably coupled to the ball using a mount;

wherein the mount is an elastic band having an unstretched diameter that is smaller than the diameter of the ball;

wherein the locating circuit is coupled to the mount;

wherein the mount is installed by stretching to have a diameter that is larger than the diameter of the ball, placing the mount around an orthodrome of the ball, and releasing the mount such that the mount encircles the ball.

2. The GPS-locating sports ball according to claim 1 wherein the locating circuit comprises a global positioning system and a wireless transceiver;

wherein the locating circuit is coupled to the ball such that movements of the locating circuit correlate with movements of the ball.

3. The GPS-locating sports ball according to claim 2 wherein the locating circuit is imbedded within the ball.

4. The GPS-locating sports ball according to claim 2 wherein the global positioning system is a Global Positioning System receiver;

wherein the global positioning system receives plurality of radio signals from satellites in the constellation of GPS satellites;

wherein the global positioning system performs calculations to determine geolocation and time information;

wherein the global positioning system delivers the geolocation information, the time information, or both to the wireless transceiver.

5. The GPS-locating sports ball according to claim 4 wherein the wireless transceiver exchanges ball information and ball commands with the smart device over a wireless communication link.

6. The GPS-locating sports ball according to claim 5 wherein the ball information comprises a positional history of the ball within a 3D dimensional space.

7. The GPS-locating sports ball according to claim 6 wherein the ball commands direct the ball to clear the positional history log of the ball.

8. The GPS-locating sports ball according to claim 6 wherein the software is operable to execute on one or more processors of the smart device;

wherein the software determines the value of the one or more physical parameters by analyzing the ball information sent from the ball to the smart device.

9. The GPS-locating sports ball according to claim 8 wherein the one or more physical parameters comprise one or more position values.

10. The GPS-locating sports ball according to claim 8 wherein the one or more physical parameters comprise one or more speed values.

11. The GPS-locating sports ball according to claim 8 wherein the one or more physical parameters comprise one or more direction values.

12. The GPS-locating sports ball according to claim 8 wherein the one or more physical parameters comprise one or more acceleration values.

13. The GPS-locating sports ball according to claim 8 wherein the one or more physical parameters comprise one or more spin values.

14. The GPS-locating sports ball according to claim 8 wherein the software determines an average value for at least one of the one or more physical parameters.

15. The GPS-locating sports ball according to claim 8 wherein the software determines a minimum value for at least one of the one or more physical parameters.

16. The GPS-locating sports ball according to claim 8 wherein the software determines a maximum value for at least one of the one or more physical parameters.

17. The GPS-locating sports ball according to claim 8 wherein the software is adapted to interact with a user via a user interface;

wherein the user interface reports the one or more physical parameters and is adapted to allow the user to interact with the one or more physical parameters.

* * * * *